US007389085B2

(12) United States Patent
Kitamura

(10) Patent No.: US 7,389,085 B2
(45) Date of Patent: Jun. 17, 2008

(54) IMAGE FORMING APPARATUS AND SHEET CONVEYING APPARATUS

(75) Inventor: Toshifumi Kitamura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 374 days.

(21) Appl. No.: 11/254,820

(22) Filed: Oct. 21, 2005

(65) Prior Publication Data

US 2006/0093419 A1 May 4, 2006

(30) Foreign Application Priority Data

Oct. 28, 2004 (JP) ..... 2004-314625

(51) Int. Cl.
*G03G 15/00* (2006.01)

(52) U.S. Cl. ..... 399/401; 399/364

(58) Field of Classification Search ..... 399/364, 399/401; 271/3.16, 291
See application file for complete search history.

(56) References Cited

FOREIGN PATENT DOCUMENTS

JP 6-92530 * 4/1994

* cited by examiner

*Primary Examiner*—Charles D. Garber
*Assistant Examiner*—Allister Primo
(74) *Attorney, Agent, or Firm*—Fitzpatrick, Cella, Harper & Scinto

(57) ABSTRACT

When a recording material is conveyed to a double surface conveying portion, a second conveying roller pair is forward driven to convey the recording material conveyed by a first conveying roller pair forward driven. A control portion performs control so that the driving of the second conveying roller pair is stopped and the second conveying roller pair is separated in timing in which the first conveying roller pair is switched from forward driving to reverse driving.

7 Claims, 11 Drawing Sheets

IMAGE FORMING APPARATUS AND SHEET CONVEYING APPARATUS

BACKGROUND OF THE INVENTION

1. Field of the Invention

The present invention relates to an image forming apparatus forming an image on a recording material, and a sheet conveying apparatus.

2. Description of the Related Art

There are various types of conveying apparatuses capable of reversing a recording material which is used in an image forming apparatus. The conveying apparatus reversing and conveying a recording material generally uses a reverse roller pair capable of receiving a fed recording material (sheet) and forward and reversely running the recording material conveyed through a predetermined conveyance passage. The recording material is captured by rotating forward the reverse roller pair, and subsequently fed to a conveyance passage different from the conveyance passage by reversely rotating the reverse roller pair. A reversing apparatus passing the recording material to a sheet discharging roller pair or passing the recording material to a conveying roller pair of a double surface conveying portion for forming an image on a rear surface of a recording medium as well has been proposed (Japanese Patent Application Laid-open No. 06-092530 (1994)).

In this case, driving a motor or solenoid for rotating rollers leads to increased power consumption and occurrence of driving sounds.

Further, in Japanese Patent Application Laid-open No. 06-092530 (1994), reversing portions used during phase down sheet discharge (hereinafter referred to as FD sheet discharge) and used during double surface printing are different. The recording material is conveyed through a different conveyance passage during double surface reversal. Further, each reverse roller should be equipped with a plurality of solenoids such as a solenoid for separation during continuous printing and a solenoid for conveyance passage switching during double surface printing. Use of such a plurality of solenoids and an increase in the number of conveying mechanical components due to the complicated conveyance passage leads to not only an increase in cost of the apparatus but also upsizing of the apparatus itself.

SUMMARY OF THE INVENTION

The present invention has been made in view of the above-mentioned problems, and its object is to simplify a conveyance passage, downsize an apparatus, and achieve energy conservation and sound reduction.

For solving the above-mentioned problems, an image forming apparatus of the present invention comprises, a recording material feeding portion feeding a recording material, an image forming portion forming an image on the recording material fed by the recording material feeding portion, a discharging portion discharging the recording material on which an image is formed by the image forming portion, a first conveying roller pair capable of forward and reversely rotating, a second conveying roller pair placed downstream from the first conveying roller pair, and separation means for mutually separating the second conveying roller pair, and comprises, a reverse conveying portion reversing the front surface and the rear surface of the recording material on which an image is formed, a double surface conveying portion conveying again to the image forming means the recording material having its front surface and rear surface reversed by the reverse conveying portion after an image is formed on one surface when images are formed on both surfaces of the recording material, and a control portion controlling the driving of the first and second conveying roller pairs and the operation of the separation means, wherein if images are formed on both surfaces of the recording material, the recording material is reversed by switching the first conveying roller pair from forward driving to reverse driving and conveyed to the double surface conveying portion, and when the recording material is conveyed to the double surface conveying portion, the control means performs control so that the second conveying roller pair is forward driven to convey the recording material conveyed by the first conveying roller pair driven forward, and the driving of the second conveying roller pair is stopped and the second conveying roller pair is separated at the time when the first conveying roller pair is switched from forward driving to reverse driving.

A sheet conveying apparatus comprises, a first conveying roller pair capable of forward and reversely rotating for reversing a sheet, a second conveying roller pair conveying a sheet, separation means for mutually separating the second conveying roller pair, and a control portion controlling the driving of the first and second conveying roller pairs and the operation of the separation means, wherein the control means performs control so that the second conveying roller pair is forward driven to convey the sheet conveyed by the forward rotating first conveying roller, and the driving of the second conveying roller pair is stopped and the second conveying roller pair is separated in timing in which the first conveying roller pair is switched from forward driving to reverse driving.

The above and other objects, effects, features and advantages of the present invention will become more apparent from the following description of embodiments thereof taken in conjunction with the accompanying drawings.

BRIEF DESCRIPTION OF THE DRAWINGS

FIG. 10 is a diagram showing the relationship of FIGS. 10A and 10B;

DETAILED DESCRIPTION OF PREFERRED EMBODIMENTS

Embodiments of the present invention will be described below with reference to the drawings. In each embodiment described below, a laser beam printer as one example of an image forming apparatus will be described.

First Embodiment

Figure 1:
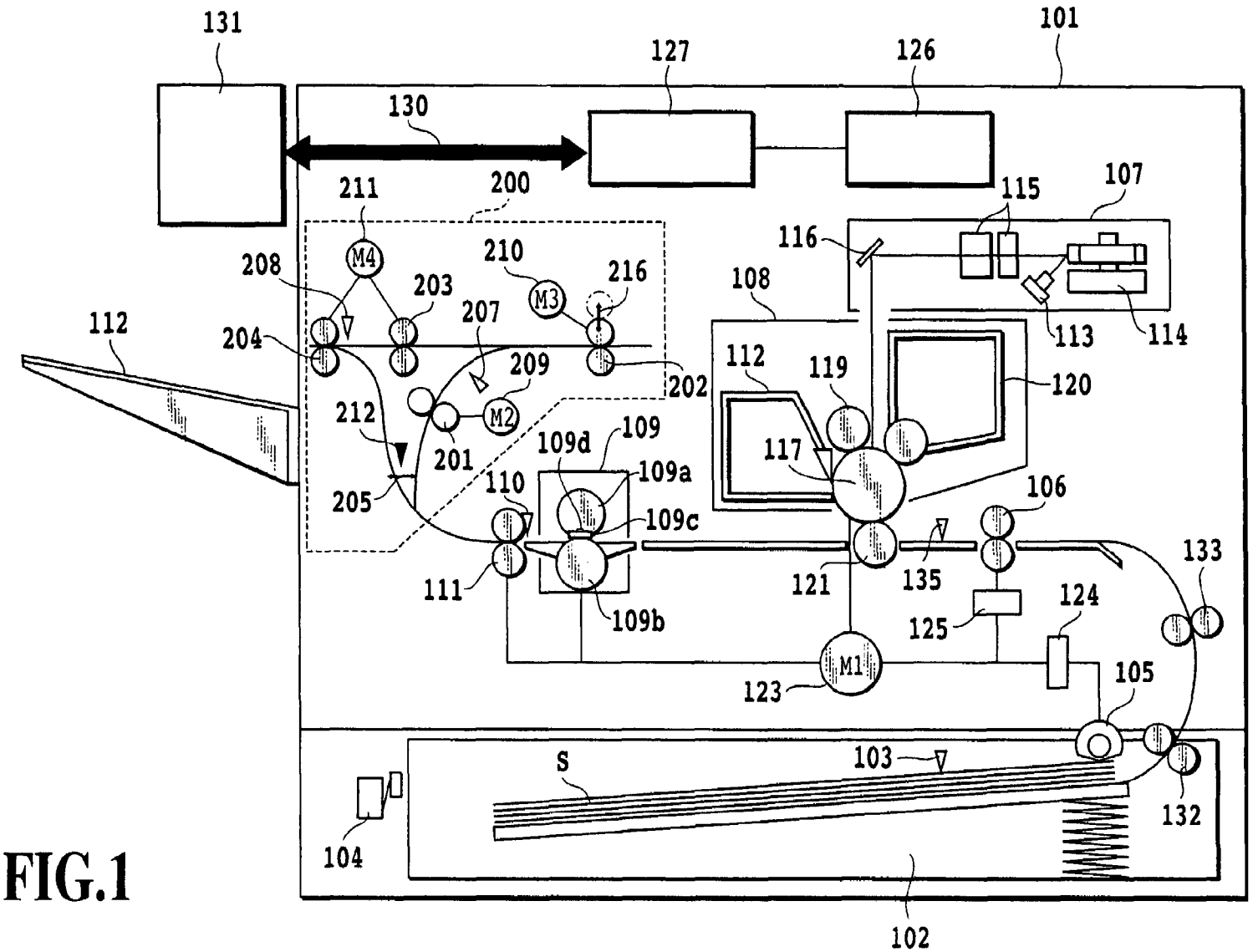
FIG. 1 is a view explaining the configuration of an image forming apparatus according to the present invention.

FIG. 1 is a sectional view showing the configuration of a laser beam printer using an electrophotographic process A laser beam printer main body 101 (hereinafter referred to as main body 101) is provided with a cassette 102 housing a recording sheet S (sheet). The main body 101 is further provided with a cassette sheet presence/absence sensor 103 detecting presence/absence of the recording sheet S in the cassette 102, and a cassette size sensor 104 (constituted by a plurality of micro-switches) detecting the size of the recording sheet S in the cassette 102. The main body 101 is provided with a sheet feeding roller 105 for separating the recording sheet S from the cassette 102 on a one-by-one basis and feeding the same, and a feed roller 132 conveying the recording sheet S fed by the sheet feeding roller 105. A recording material feeding portion is constituted by the cassette 102 and the sheet feeding roller 105.

A resist roller pair 106 conveys the recording sheet S by the feed roller 132 and an intermediate roller 133.

A laser scanner portion 107 comprises a laser unit 113, a polygon motor 114, an image formation lens 115 and a folded mirror 116. The laser unit 113 emits laser light modulated based on an image signal (VDO signal) obtained by spread processing of image information sent from an external apparatus 131 described later. A polygon motor 114 rotates a polygon mirror for scanning a photosensitive drum 117 described later with laser light from the laser unit 113. The image formation lens 115 causes laser light from the polygon mirror to form an image on the photosensitive drum 117.

A cartridge 108 forming a toner image on the recording sheet S based on laser light from a laser scanner portion 107 is provided downstream in the conveyance direction of the resist roller pair 106. The cartridge 108 includes various configurations for forming an image on the recording sheet S in an electrophotographic mode. The cartridge 108 comprises, for example, the photosensitive drum 117, a primary charging roller 119 charging the surface of the photosensitive drum 117 to a uniform potential, a developing device 120 developing by a toner an electrostatic latent image formed on the surface of the photosensitive drum 117 by exposure to laser light, a transferring roller 121 applying a voltage having a polarity opposite to that of the toner to the photosensitive drum 117 from the rear surface of the recording sheet S for transferring a toner image developed on the photosensitive drum 117 to the recording sheet S conveyed by the resist roller pair 106, a cleaner 122 collecting a residual toner remaining on the photosensitive drum 117 without being transferred to the recording sheet S by the transferring roller 121, and the like. A top sensor 135 providing reference timing for image formation and fixation control is provided between the resist roller pair 106 and the transferring roller 121.

A fixing device 109 thermally fixes a toner image formed on the recording sheet S downstream in the conveyance direction of the cartridge 108. The fixing device 109 is constituted by a fixing film 109*a*, a pressure roller 109*b*, a ceramic heater 109*c* provided in the fixing film 109*a* and heating a toner image on the recording sheet by heat generation, a thermistor 109*d* detecting the temperature of the surface of the ceramic heater 109*c*, and the like.

A fixation sensor 110 detecting presence/absence of the recording sheet S, a fixing roller 111 discharging the recording sheet S on which a toner image is fixed by the fixing device 109, and a reverse conveying portion 200 for discharging the recording sheet S from the main body 101 in face-up (hereinafter referred to as FU) corresponding to a normal output or face-down (hereinafter referred to FD) corresponding to a reverse output, downstream in the conveyance direction of the fixing roller 111, are provided downstream in the conveyance direction of the fixing device 109.

Figure 2:
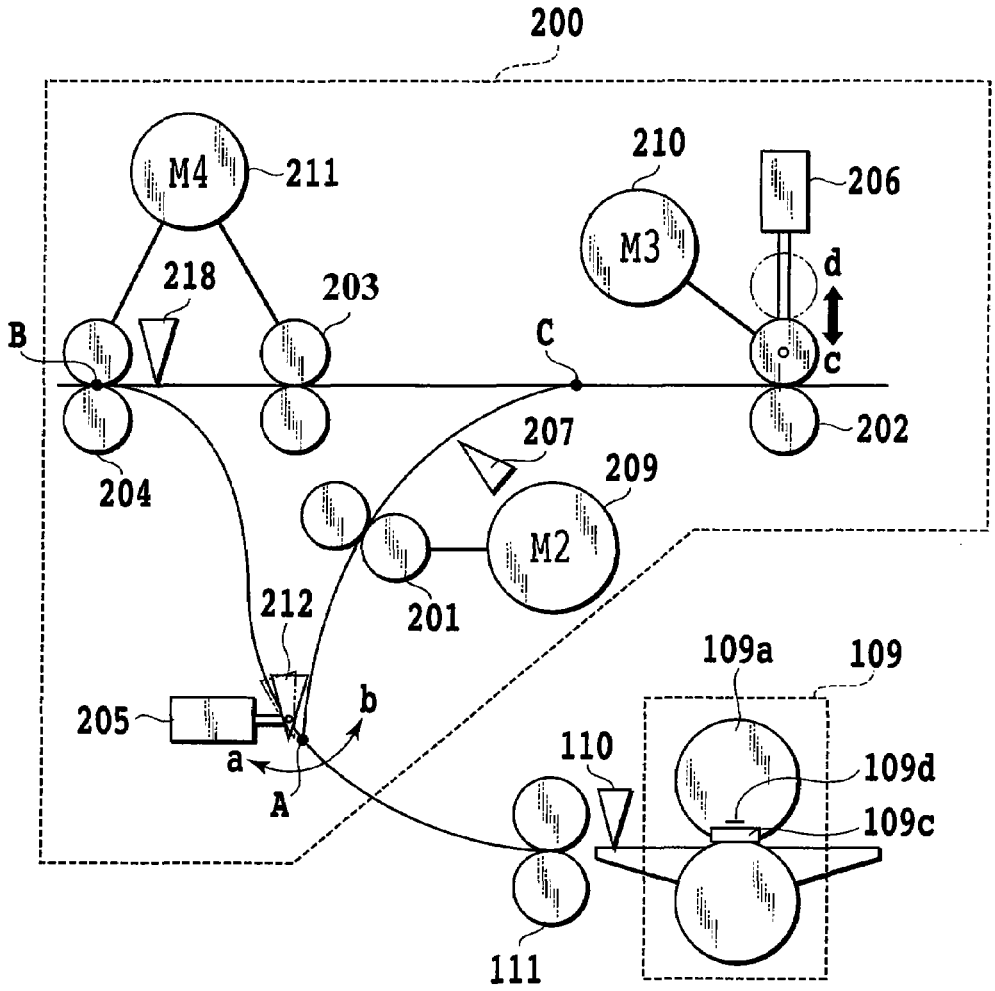
FIG. 2 is a view explaining the configuration of a reverse conveying portion according to the present invention.

The configuration of the reverse conveying portion 200 being reversing means will be described using FIG. 2. FIG. 2 is a sectional view showing the configuration of the reverse conveying portion 200.

The reverse conveying portion 200 has two conveyance passages: a FU conveyance passage and a FD conveyance passage. The FU conveyance passage as a first conveyance passage is a conveyance passage discharging the recording sheet S passing through the fixing device 109 with its image formation surface facing upward into a loading tray 112 with its image formation surface facing upward. Namely, the FU conveyance passage discharges the recording material into the loading tray 112 by way of A point and then B point in the figure. The FD conveyance passage discharges the recording sheet S passing through the fixing device 109 with its image formation surface facing upward into the loading tray 112 with its image formation surface facing downward. Namely, the FD conveyance passage discharges the recording material into the loading tray 112 by way of A point, C point and then B point in the figure.

The reverse conveying portion 200 is further provided with a merging roller 201 forward and reversely rotatably driven by a merging motor 209, a reversing roller 202 forward and reversely rotatably driven by a reversing motor 210, an intermediate roller 203 driven by a sheet discharging motor 211, a sheet discharging roller 204 driven also by the sheet discharging motor 211, a FD/FU switching flapper 212 making a switch on whether the recording sheet S is to be discharged into the loading tray 112 as a discharging portion by way of the FU conveyance passage or FD conveyance passage, a FD/FU switching solenoid 205 switching the position of the front end of the FD/FU switching flapper 212 between positions a and b in the figure, a separation solenoid 206 switching a roller pair constituting the reversing roller 202 from the contact state c in the figure to the separation state d in the figure, a reversal sensor 207 provided downstream in the conveyance direction of the merging roller 201 on the FD conveyance passage from A point to B point and detecting presence/absence of the recording sheet S, and a sheet discharge sensor 208 provided downstream in the conveyance direction of the intermediate roller 203 on the FD conveyance passage from A point to B point and detecting presence/absence of the recording sheet S.

The main body 101 further comprises a main motor 123. The main motor 123 supplies drive power to each portion in the main body 101. The main motor 123 supplies drive powers to the sheet feeding roller 105, the feed roller 132, the intermediate roller 133, the resist roller 106, the photosensitive drum 117, the primary charging roller 119, the transferring roller 121, the fixing device 109, the sheet discharging roller 111 and the like.

The sheet feeding roller 105 and the resist roller pair 106 do not always rotate while the main motor rotates. The sheet feeding roller 105 and the resist roller pair 106 are switched between a state in which the drive power of the main motor 123 is transmitted and a state in which the drive power of the main motor 123 is not transmitted by a sheet feeding roller clutch 124 and a resist roller clutch 125 of which the on/off state is controlled by an engine controller 126 described later. The sheet feeding roller 105 and the resist roller pair 106 are controlled to convey the recording sheet S in desired timing by switching between the state in which the drive power of the main motor 123 is transmitted and the state in which the drive power is not transmitted.

Figure 3:
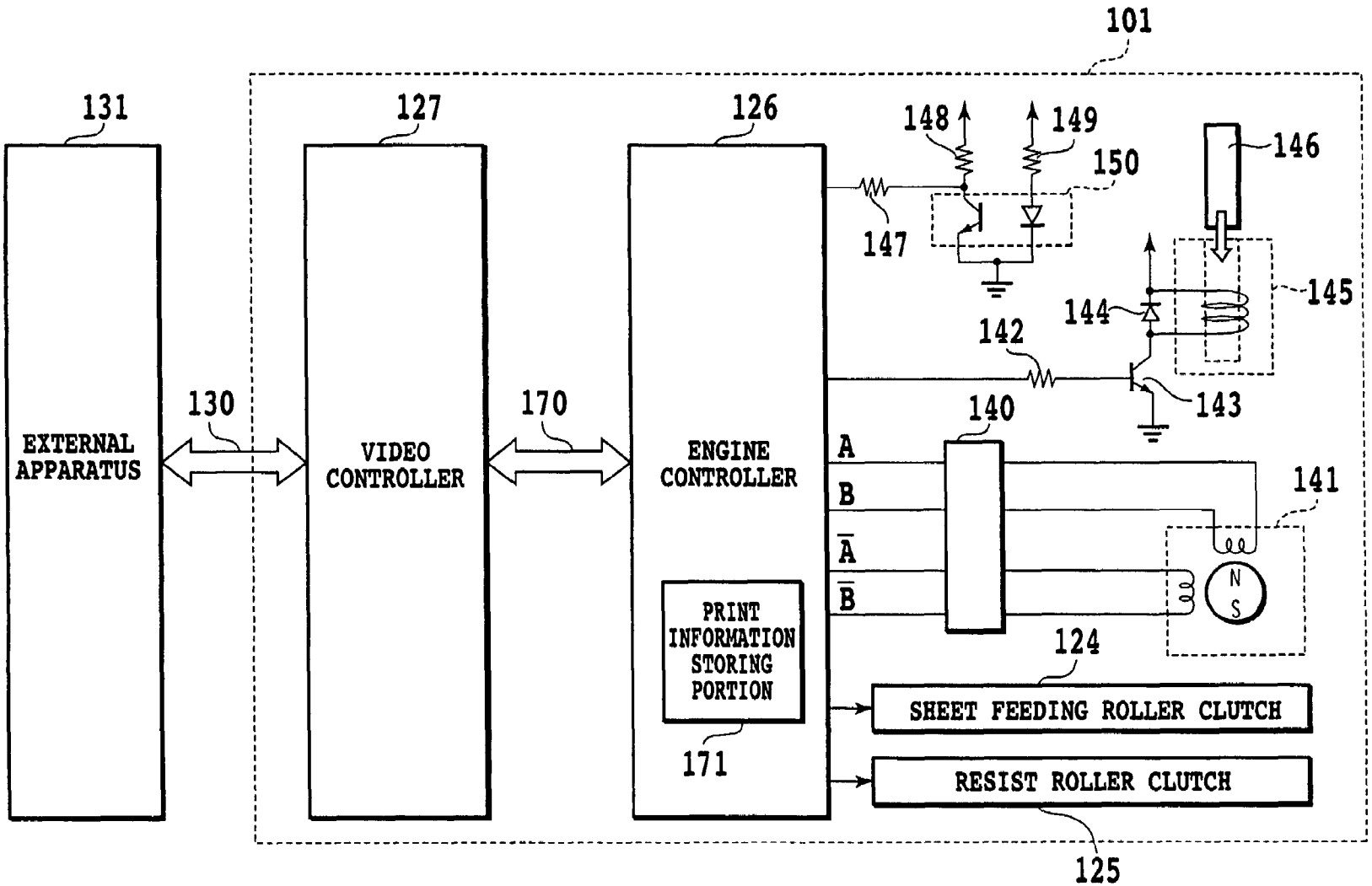
FIG. 3 is a view explaining the electrical configuration of the image forming apparatus according to the present invention.

The configuration of control of the main body 101 will now be described using FIG. 3. FIG. 3 is a block diagram showing the configuration of control of the main body 101. The external apparatus 131 such as a personal computer sends image information to be printed to the main body 101 via a universal interface 130 (Centronics, RS232C, etc.) together with print information. The print information is information of the size of the recording sheet S, information of specification of the sheet feeding cassette, information of whether double surface printing is performed or not, and the like.

A video controller 127 spreads image information sent from the external apparatus 131 into bit data and converts the same into an image signal (VDO signal), and sends the VDO signal to the engine controller 126 via a video interface 170.

The engine controller 126 controls each portion of the main body 101. The engine controller 126 controls a charge bias applied to the primary charging roller 119, the light amount of the laser unit 113, the number of revolutions of the polygon motor 114, a development bias applied to a developing roller constituting the developing device 120, and the like. The engine controller 126 functions as a control portion controlling each portion involved in conveyance of the recording sheet S.

A motor 141, a solenoid 145 and a sensor 150 are an actuator portion constituting the reverse conveying portion 200. The motor 141 mentioned herein is a generic term of the merging motor 209, the reversing motor 210 and the sheet discharging motor 211. The solenoid 145 is a generic term of the FD/FU switching solenoid 205 and the separation solenoid 206. The sensor 150 is a generic term of the reversal sensor 207 and the sheet discharge sensor 208.

The merging motor 209, the reversing motor 210 and the sheet discharging motor 211 of the reverse conveying portion 200 are stepping motors. The merging motor 209, the reversing motor 210 and the sheet discharging motor 211 are driven by a signal from the engine controller 126. As shown in FIG. 3, the engine controller 126 switches the magnetic excitation of the stepping motor by sending a pulse signal to a motor drive IC 140. The motor drive IC 140 which has received the pulse signal from the engine controller 126 controls the direction of a current passing through a coil in the motor 141 in response to the pulse signal. At this time, a field pole in the motor 141 reversely rotates and thereby a magnet is rotated.

The rotation speed of the motor 141 depends on the period of the pulse signal sent from the engine controller 126. The shorter the pulse period sent from the engine controller 126, the faster the reverse period of the field pole in the motor 141 and the faster the rotation speed of the motor 141. The engine controller 126 switches the ON/OFF state by sending signals of H/L to the FU/FD switching solenoid 205 and the separation solenoid 206.

For a resistor 142, a transistor 143 and a protective diode 144 in FIG. 3, the transistor 143 is in the ON state if the signal output by the engine controller 126 is H (high). As the transistor 143 is in the ON state, a magnetic field is generated by a current passing through a coil of the solenoid 145, and a plunger 146 is drawn into the solenoid.

The plunger 146 of the FD/FU switching solenoid 205 is connected to the front end of the FD/FU switching flapper 212. The engine controller 126 switches to H or L the signal output to the FD/FU switching solenoid 205, whereby the conveyance passage through which the recording sheet is conveyed with the front end of the FD/FU switching flapper 212 situated at the position a or b in FIG. 2 is switched to the FD conveyance passage (when the front end of the FD/FU switching flapper 212 is situated at the position a) or the FU conveyance passage (when the front end of the FD/FU switching flapper 212 is situated at the position b).

The reversal sensor 207 and the sheet discharge sensor 208 are photosensors detecting a recording sheet conveyance state. When the recording sheet S reaches the positions of the reversal sensor 207 and the sheet discharge sensor 208 (hereinafter referred to as sensor 150), alight blocking member provided on the conveyance passage is pushed by the recording sheet S to block light between the photodiode and the phototransistor in the sensor 150, and the H signal ("sheet present" in this embodiment) is sent to the engine controller 126. When the recording sheet S is not present at the position of the sensor 150, the L signal ("sheet absent" in this embodiment) is sent from the sensor 150 to the engine controller 126.

The engine controller 126 has, in an internal storage portion such as a memory, a print information storing portion 171 storing the aforesaid print information input via the video controller 127 from the external apparatus 131 and print information specified from the video controller 127.

Figure 4:
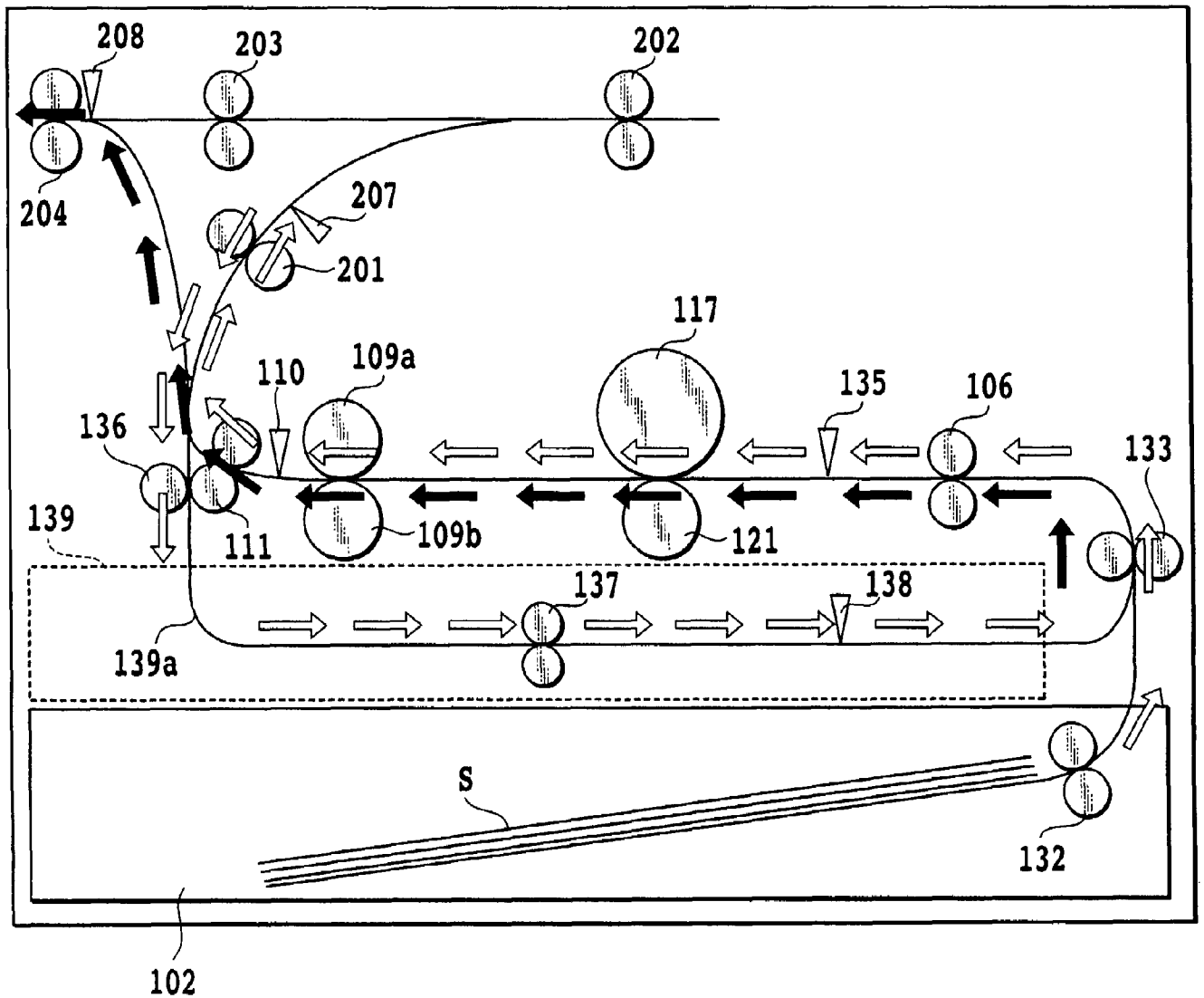
FIG. 4 is a view explaining a flow of double surface printing according to the present invention.

As shown in FIG. 4, a double surface unit 139 can be connected to the main body 101.

As shown by the arrow in FIG. 4, the recording sheet S fed from the cassette 102 passes through the top sensor 135 and is conveyed to the fixation sensor 110 in the fixing device 109. The front end of the recording sheet S, which has passed through the fixation sensor 110, is conveyed to the FD sheet discharging passage and then conveyed to the reversal sensor 207. Thereafter, when the rear end of the recording sheet S leaves the fixation roller 111, the merging motor 209 is reversely driven to convey the recording sheet S to a double surface conveyance passage 139*a* of a double surface unit 139. The operation of the reverse conveying portion 200 in which the merging roller 201 is reversed by the merging motor 209, whereby the recording material is reversed and conveyed to the double surface conveyance passage 139*a* will be hereinafter referred to as double surface reversal.

The entrance of the double surface unit 139 is provided with a double surface entrance roller 136 accepting the recording sheet S. Conveyance of the recording sheet S in the double surface conveyance passage 139*a* in the double surface unit 139 is carried out by a double surface roller 137. A refeeding sensor 138 is provided on the double surface conveyance passage as a double surface conveyance portion. The recording sheet S discharged from the double surface unit 139 is conveyed by the intermediate roller 133, and discharged by way of the top sensor 135 and the fixation sensor 110 (an arrow is shown as a route of FU sheet discharge as an example in FIG. 4).

Figure 5:
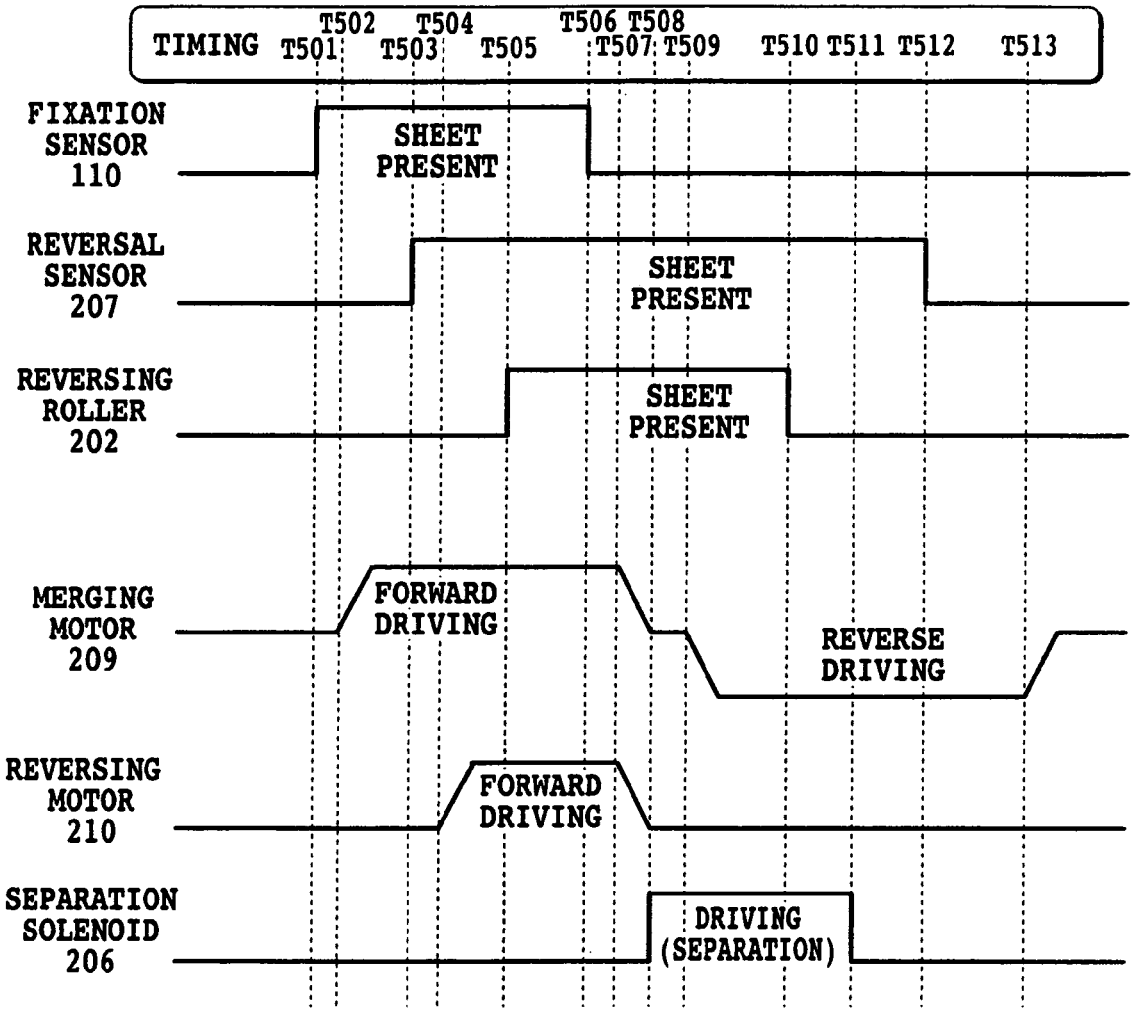
FIG. 5 is a time chart relating to double surface reversal control according to the present invention.

If the recording material is conveyed to the double surface unit 139 for forming images on both surfaces of the recording sheet S in the laser beam printer main body 101 having the above configuration, the merging motor 209 is switched from forward driving to reverse driving for reversing the recording material. The flow of control of the driving of the reversing motor 210 and the separation solenoid 206 when the merging motor 209 is switched from forward driving to reverse driving will be described using the time chart of FIG. 5.

First, the front end of the recording sheet S having an image formed on one surface reaches the fixation sensor 110 in the fixing device 109 in timing T501. Next, the forward driving of the merging motor 209 is started in timing T502, and the front end of the recording sheet S reaches the reversal sensor 207 in timing T503.

After the recording sheet S reaches the reversal sensor 207, the forward driving of the reversing motor 210 is started in predetermined timing T504, and the front end of the recording sheet S reaches the reverse roller 202 in timing T505. Thereafter, the rear end of the recording sheet S leaves the fixation sensor 110 in timing T506, and then the forward driving merging motor 209 and reversing motor 210 are stopped in predetermined timing T507. Thereafter, in timing T508, the separation solenoid 206 is driven (a separation state is created) and at the same time, the merging motor 209 starts initial magnetic excitation before starting a reverse operation, and the merging motor 209 starts reverse driving in timing T509.

The direction of conveyance of the recording sheet S is reversed to the reverse driving of the merging motor 209, the recording sheet is conveyed to the double surface unit 139, the separation solenoid is stopped (separation is cancelled) in predetermined timing T511 after the rear end of the recording sheet S leaves the reversing roller 202 in timing T510, the merging motor 209 is stopped in predetermined timing T513 after the rear end of the recording sheet S leaves the reversal sensor 207 in timing T512, delivery of the recording sheet S from the reverse converting portion 200 to the double surface unit 139 is completed, and double surface reversal control is ended.

As a result, the reversing portion for switching between FD sheet discharge and FU sheet discharge can also be used during double surface printing, and thus a compact and low-cost image forming apparatus is provided.

Control of the driving of the reversing motor 210 and the separation solenoid 206 when images are formed on both surfaces and the sheet is discharged in face-down will now be described.

Figure 6:
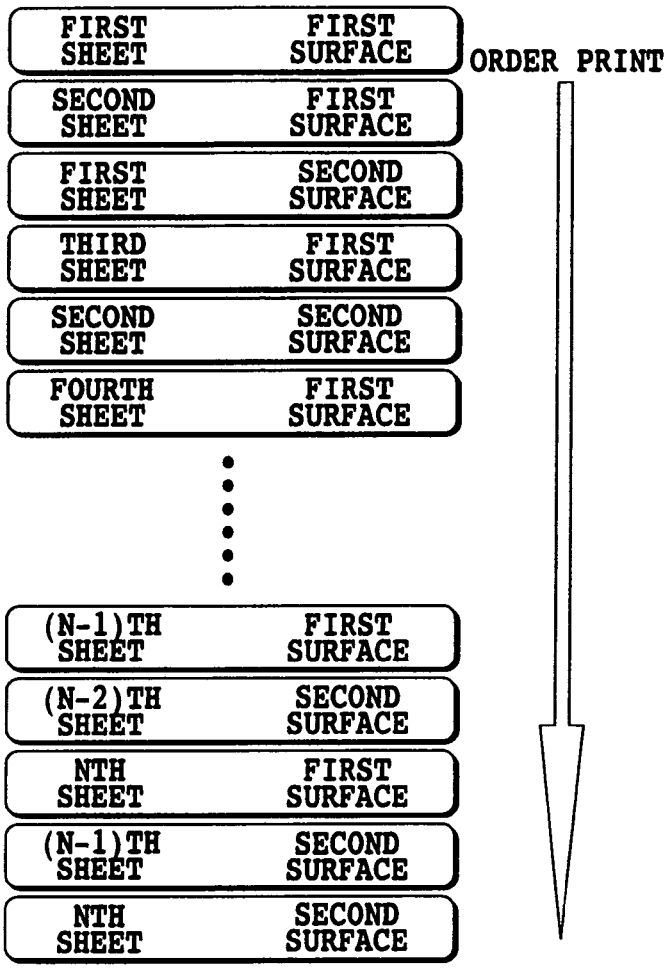
FIG. 6 is a view explaining the order of double surface printing according to the present invention.

First, the printing order of double surface printing will be described. As shown in FIG. 6, formation of images on the first and second surfaces of the recording sheet S is performed alternately. Therefore, in the reverse conveying portion 200, control of FD sheet discharge and double surface reversal is performed alternately. The FD sheet discharge is an operation of the reverse conveying portion 200 in which the recording material reversed by switching the reversing roller 202 from forward rotation to reverse rotation is conveyed to the sheet discharging roller 204.

Figure 7:
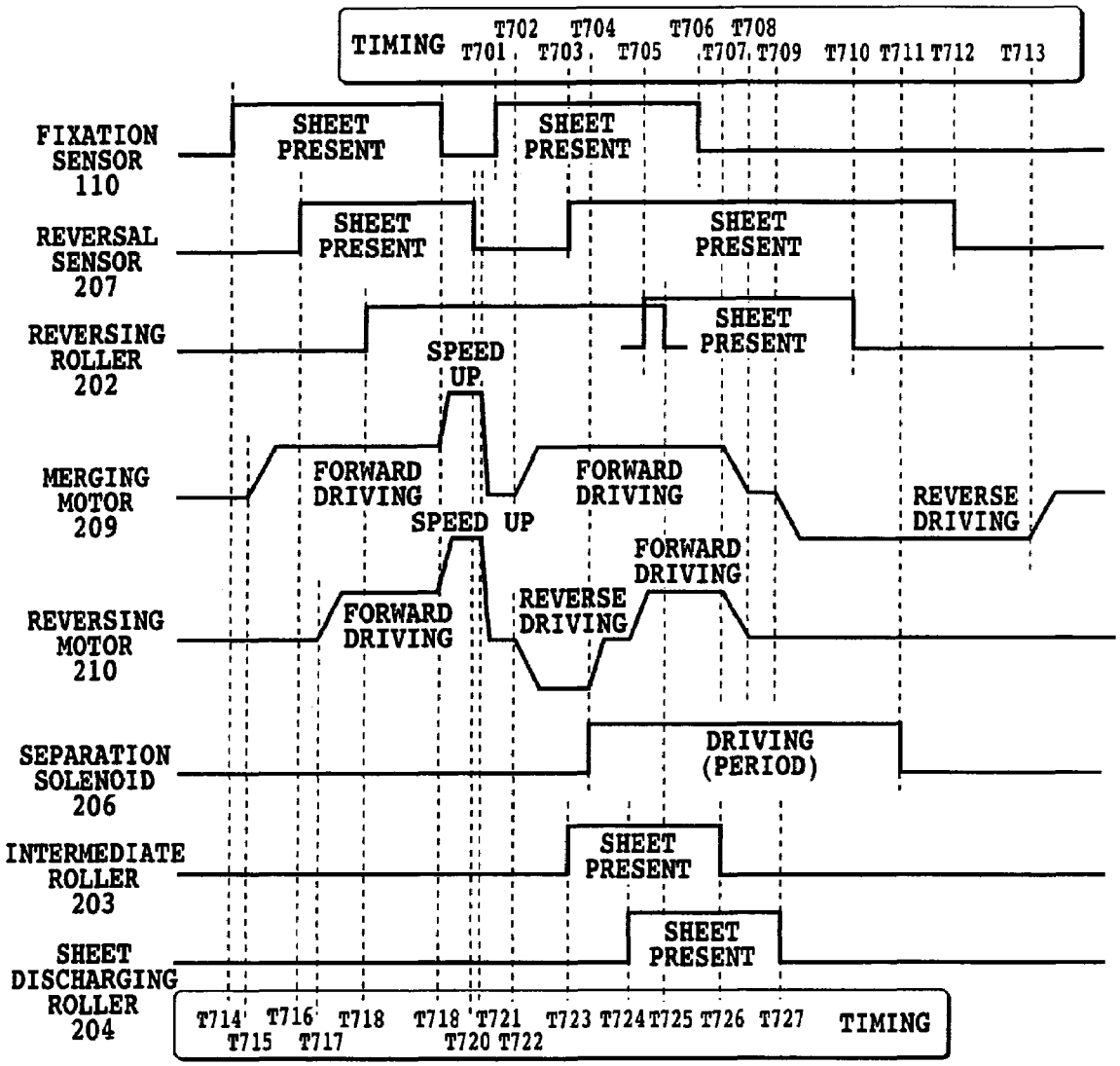
FIG. 7 is a time chart relating to double surface reversal control according to the present invention.

The flow of control of the driving of the reversing motor 210 and the separation solenoid 206 when images are formed on both surfaces and the sheet is discharged in face-down will be described using the time chart of FIG. 7. FIG. 7 is a flow chart where the preceding recording material is FD-discharged and the following recording material is subjected to double surface reversal.

First, the front end of the recording sheet S (FD-discharged sheet) which has images formed on both surfaces and is FD-discharged reaches the fixation sensor 110 in the fixing device 109 in timing T714. Next, the forward driving of the merging motor 209 is started in timing T715, and the front end of the recording sheet S (FD-discharged sheet) reaches the reversal sensor 207 in timing T716. After the recording sheet S (FD-discharged sheet) reaches the reversal sensor 207, the forward driving of the reversing motor 210 is started in predetermined timing T717, and the front end of the recording sheet S (FD-discharged sheet) reaches the reversing roller 202 in timing T718. Thereafter, the rear end of the recording sheet S (FD-discharged sheet) leaves the fixation sensor 110 and at the same time, the rotation speeds of the merging motor 209 and the reversing motor 210 are increased in timing T719. Here, the control of the increase in speed is intended for widening the space between the preceding sheet and the following sheet for preventing sheet collision in pass-by reversal on the assumption of continuous FD printing.

Then, after the rear end of the recording sheet S (FD-discharged sheet) leaves the reversal sensor 207 in timing T720, the merging motor 209 and the reversing motor 210 are stopped in timing T721, the reversing motor 210 starts initial magnetic excitation before starting reverse driving, and the reversing motor 210 starts reverse driving in timing T722.

The front end of the recording sheet S (FD-discharged sheet) conveyed by the reverse driving of the reversing motor 210 reaches the intermediate roller 203 driven by the sheet discharging motor 211 in timing T723 and then reaches the sheet discharging roller 204 in timing T724, and then the rear end of the recording sheet S (FD-discharged sheet) leaves the reversing roller 202 in timing T725, then leaves the intermediate roller 203 in timing T726, then leaves the sheet discharging roller 204 in timing T727, and is finally discharged into the loading portion 112.

As for the recording sheet S (subjected to double surface reversal) which is the following recording material, control almost same as that described above is performed, and therefore only different aspects will be described below.

The preceding recording sheet S (FD-discharged sheet) and the following recording sheet S (subjected to double surface reversal) are fed into the reverse conveying portion 200 with a space identical to that during continuous FD printing. Therefore, when control should be performed so that the reversing motor 210 is forward driven in timing T704 after the front end of the following recording sheet S (subjected to double surface reversal) reaches the reversal sensor 207 in timing T703, the reversing motor 210 is being reversely driven (conveying the sheet to the loading portion 112) due to control of the preceding recording sheet S (FD-discharged sheet), resulting in duplication of control of the reversing motor 210.

However, no problem arises because in timing T704, the front end of the preceding recording sheet S (FD-discharged sheet) reaches the intermediate roller 203, and the conveyance power for the preceding recording sheet S (FD-discharged sheet) is caught by the intermediate roller even if the reversing roller 202 is separated. Thus, in this embodiment, the separation solenoid 206 is driven (a separation state is created), the reverse driving of the reversing motor 210 is stopped, and the reversing motor 210 is switched to forward driving in timing T704. Thereafter, when the front end of the following recording sheet S (subjected to double surface reversal) reaches the reversing roller 202 in timing T705, the rear end of the preceding recording sheet S (FD-discharged sheet) and the front end of the following recording sheet S (subjected to double surface reversal) coexist in the separated reversing roller 202. Namely, the rearend of the preceding recording material and the front end of the following recording material pass by each other at a location where the reversing roller 202 is provided. Descriptions for timing T707 and subsequent timings are not presented here because they are same as those described previously.

Figure 8:
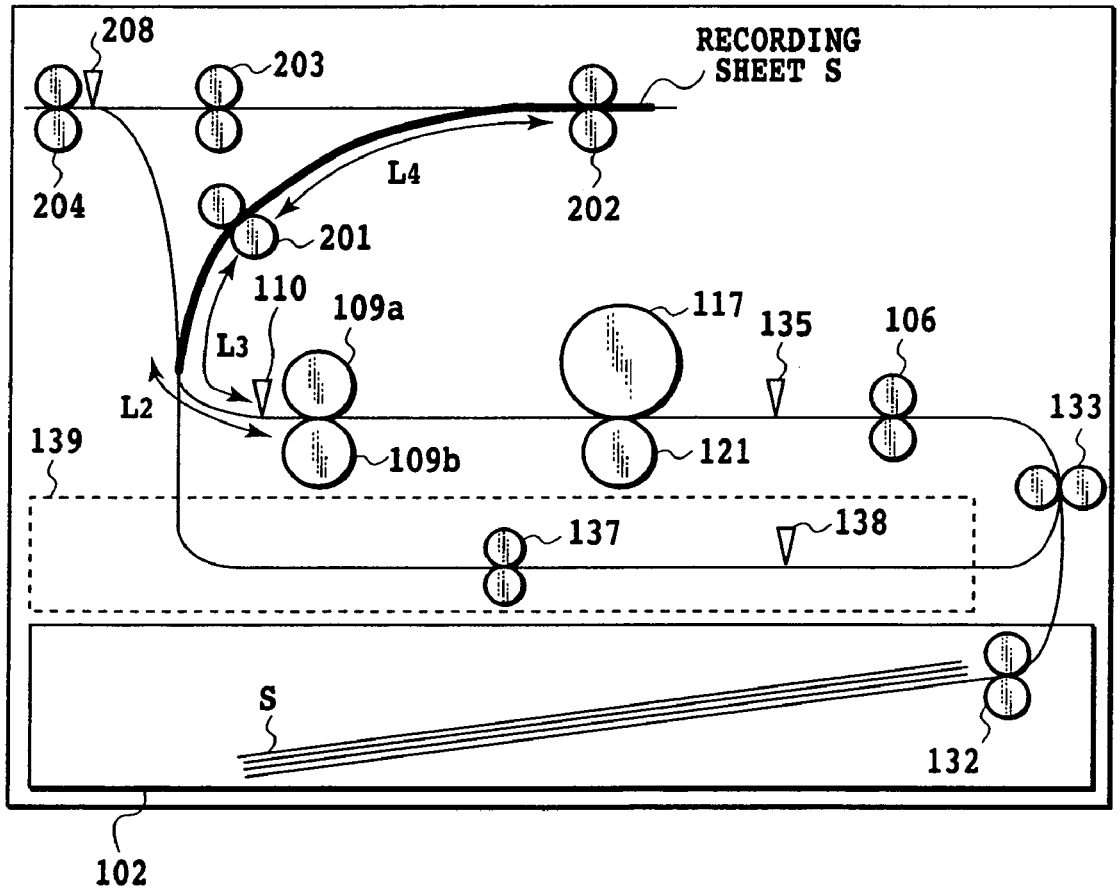
FIG. 8 is a view explaining a sheet stop position at the time of double surface reversal control according to the present invention.

Embodiment for Coping with the Case where Recording Materials have Different Lengths This embodiment is identical in configuration to the first embodiment. This embodiment is different in control from the first embodiment in that the size of the recording sheet S is detected and based on the result thereof, the time of driving the separation solenoid 206 is changed. In this embodiment, the size of the recording sheet S is detected using the top sensor 135. A method for detecting the sheet size using the top sensor 135 and a method for determining whether or not the front end of the recording sheet S reaches the reversing roller 202 during reversal of both sides will be described below using FIGS. 5 and 8.

If the time required after the front end of the recording sheet S is detected by the top sensor 135 until the rear end is detected is t1 [sec], and the conveyance speed of the recording sheet S is V [mm/sec], the size (length) L1 [mm] of the recording sheet S along the sheet conveyance direction is determined by L1 [mm]=t1 [sec]×V [mm/sec]. Here, as described in the embodiment 1, the recording sheet S subjected to double surface reversal is stopped in predetermined timing T507 after the rear end of the recording sheet S leaves the fixation sensor 110 in timing T506. The distance L2 [mm] between the fixation sensor 110 and the position at which the rear end of the recording sheet S is stopped is determined by calculation of L2 [mm]=(T507−T506) [sec]×V [mm/sec]. If the distance between the fixation sensor 110 and the merging roller 201 is L3 [mm], the distance between the merging roller 201 and the reversing roller 202 is L4 [mm], and the requirement of L1>(L3−L2) [mm]+L4 [mm] is met, it can be determined that the front end of the recording sheet S reaches the reversing roller 202 during double surface reversal.

Figure 9:
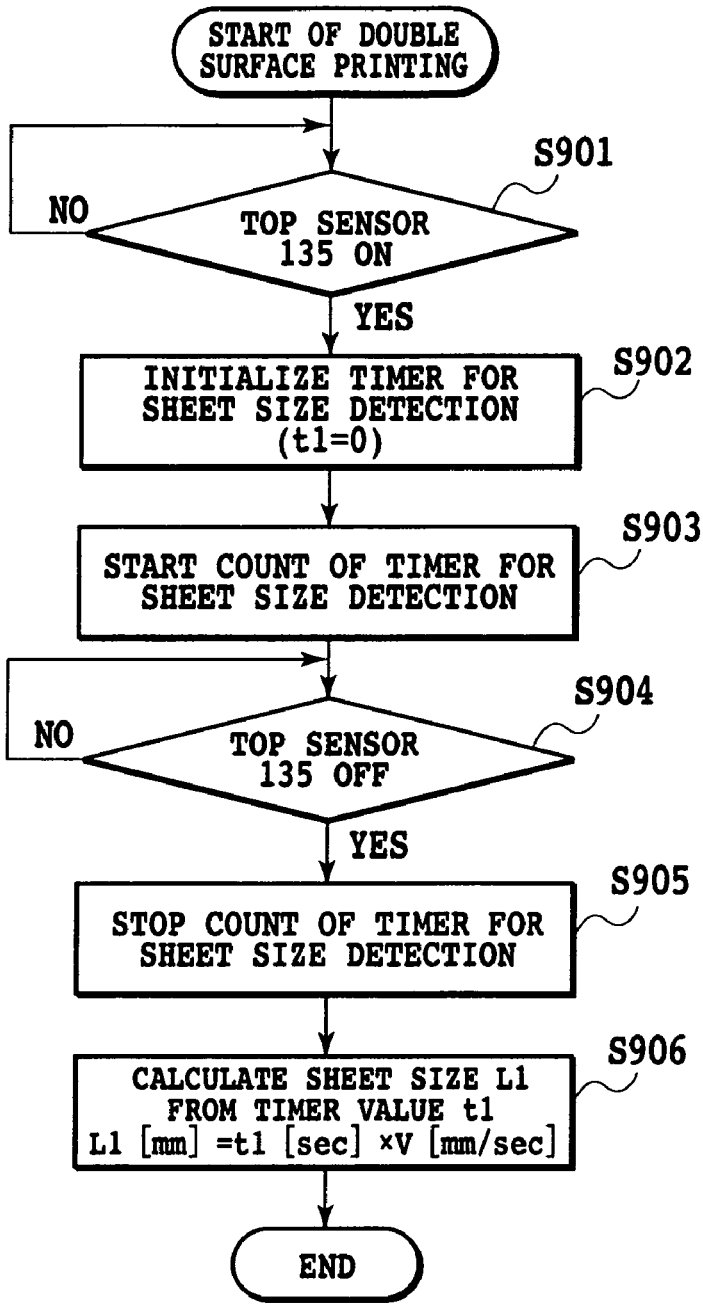
FIG. 9 is a flow chart of sheet size detection by a top sensor according to the present invention.

Detection of the size of the recording sheet S by the top sensor 135 described above will be described using the flow chart of FIG. 9. When double surface printing is started, and the front end of the recording sheet D is detected by the top sensor 135 at step S901, a timer for sheet size detection is initialized at step S902, and the count of the timer for sheet size detection is started at step S903. Then, when the rear end of the recording sheet S is detected by the top sensor 135 at step S904, the count of the timer for sheet size detection is stopped at step S905, and the timer value at this time is used to calculate the sheet size (length along the conveyance direction) at step S906.

Figure 10A:
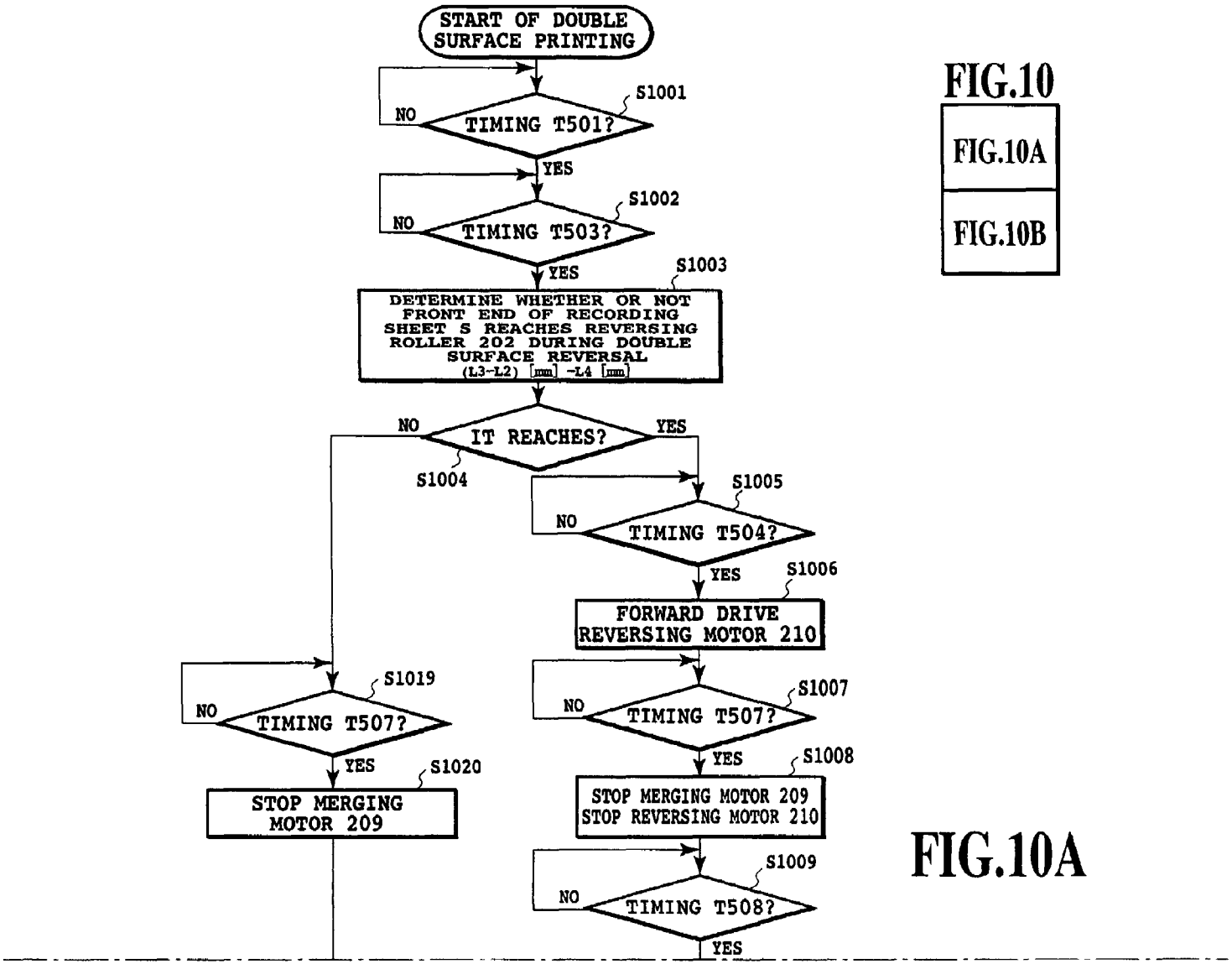
FIG. 10A is a flow chart relating to double surface reversal control according to the present invention.
Figure 10B:
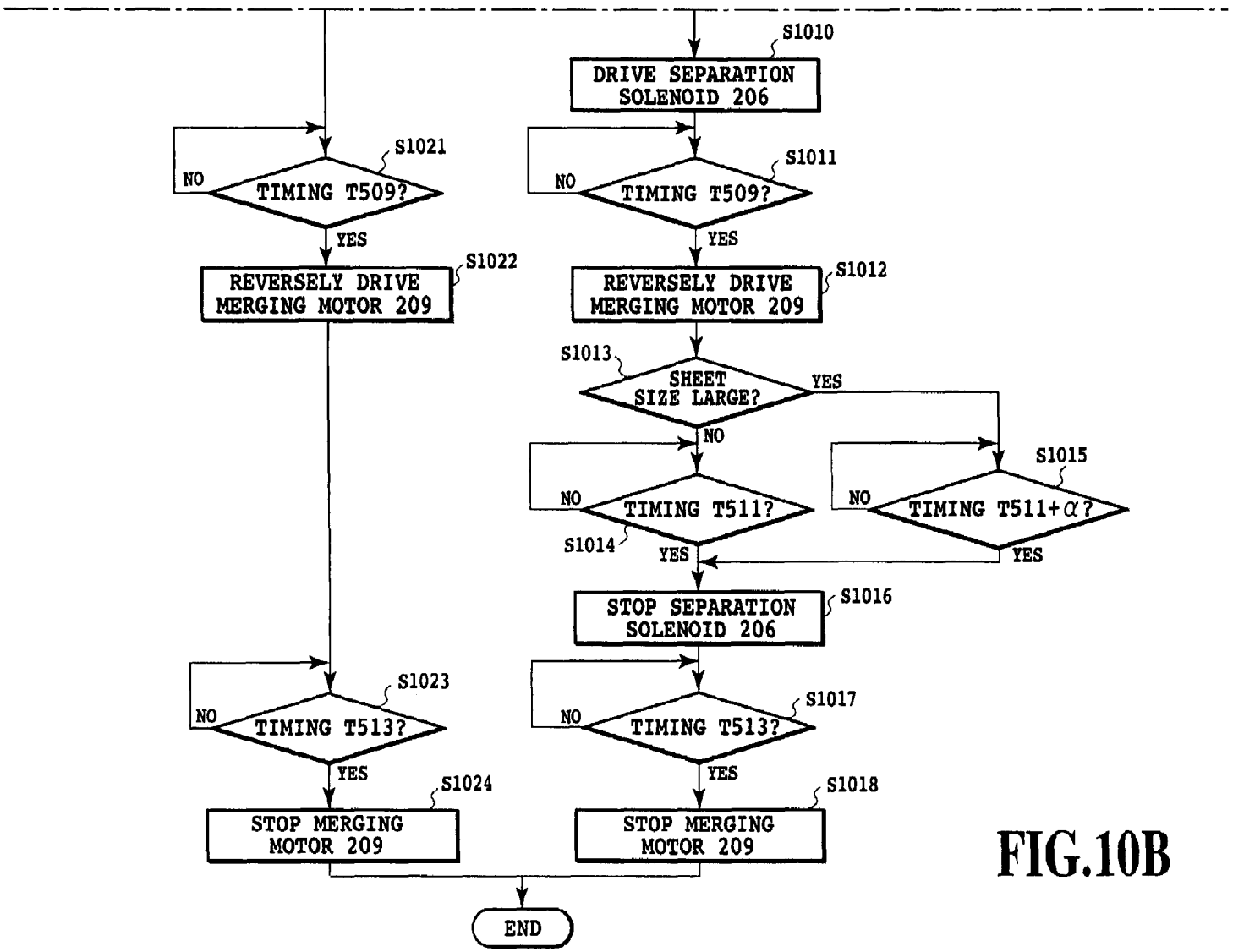
FIG. 10B is a flow chart relating to double surface reversal control according to the present invention.

The flow of control of the driving of the reversing motor 210 and the separation solenoid 206 during double surface reversal in this embodiment based on the result of size detection will now be described using the flow chart of FIG. 10A-10B. Assume that timing of control described in FIG. 10A-10B is compliant with the time chart of FIG. 5 used for description of the first embodiment.

Double surface printing is started, the front end of the recording sheet S to be subjected to double surface reversal is detected by the fixation sensor 110 at step S1001, and subsequently the front end of the recording sheet S is detected by the reversal sensor 207 at step S1002. Then, in the sheet size determined in FIG. 9, whether or not the front end of the recording sheet S reaches the reversing roller 202 is determined at step S1003, and if it is determined at step S1004 that it reaches the reversing roller 202, processing branches to step S1005. Subsequent operations are almost same as those of the first embodiment, and therefore only different aspects will be described.

The merging motor 209 is reversely driven at step S1012, and then the sheet size is determined at step S1013. If it is determined at step S1013 that the sheet size is not large, subsequent operations are same as those of the first embodiment, and therefore description thereof is not presented. If it is determined at step S1013 that the sheet size is large, the time required until the rear end of the recording sheet S leaves the reversing roller 202 is long, and accordingly one waits for timing (timing in which the separation solenoid is stopped to cancel separation of the reversing roller) T511+α at step S1015. Subsequent operations are same as those of the first embodiment, and therefore description thereof is not presented.

If it is determined at step S1004 that the front end of the recording sheet S does not reach the reversing roller 202, the reversing motor 210 and the separation solenoid 206 are not driven, but the merging motor 209 is stopped at step S1020, the merging motor 209 is reversely driven at step S1022, and the merging motor 209 is stopped at step S1024 in respective timing.

The value of α is a value previously set according to the size of the sheet which is used in the image forming apparatus, and for example, the value is set so that it is determined that the sheet size is large if the recording sheet has a size larger than the A4 size, and the separation of the reversing roller is controlled using a value obtained by adding a predetermined value α to timing T511 where it is not determined that the sheet size is large.

The example in which the length of the recording material along the conveyance direction is detected based on the time required after the front end of the recording sheet S by the top sensor 135 until the rear end is detected has been shown. However, the size of the recording material along the conveyance direction may be detected by the cassette size sensor 104 detecting the size of the recording sheet S in the cassette 102 to control the above-mentioned control based on the detection result. Furthermore, the control may be based on an input from an operation portion provided in the apparatus main body 105, or print information sent from the external apparatus 131 such as a personal computer. The length of the recording material may be detected based on job information input from the print.

As a result, total printing time can be reduced using the reverse conveying portion efficiently.

In the embodiment described above, the conveyance passage can be simplified while having functions such as FD reversal and double surface reversal. A reduction in size of the apparatus can be achieved. Furthermore, in the embodiment described above, unnecessary rotation of the reversing roller pair is avoided, and therefore noises can be reduced, thus making it possible to contribute to energy conservation.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2004-314625 filed Oct. 28, 2004, which is hereby incorporated by reference herein.

What is claimed is:

1. An image forming apparatus comprising:

a recording material feeding portion for feeding a recording material;

an image forming portion for forming an image on the recording material fed by said recording material feeding portion;

a discharging portion for discharging the recording material on which an image is formed by said image forming portion;

a reverse conveying portion for reversing the front surface and the rear surface of the recording material on which an image is formed by said image forming apparatus, including a first conveying roller pair capable of forward and reversely rotating, a second conveying roller pair placed downstream from said first conveying roller pair, and separation means for mutually separating the second conveying roller pair;

a double surface conveying portion for conveying again to said image forming means the recording material having an image formed on one surface and having its front surface and rear surface reversed by said reverse conveying portion for forming images on both surfaces of the recording material; and a control portion for controlling the driving of said first and second conveying roller pairs and the operation of said separation means, wherein if images are formed on both surfaces of the recording material, the recording material is reversed by switching said first conveying roller pair from forward driving to reverse driving and conveyed to said double surface conveying portion, and when the recording material is conveyed to said double surface conveying portion, said control means performs control so that said second conveying roller pair is forward driven to convey the recording material conveyed by said first conveying roller pair driven forward, and the driving of said second conveying roller pair is stopped and said second conveying roller pair is separated at the time when said first conveying roller pair is switched from forward driving to reverse driving.

2. The image forming apparatus according to claim 1, wherein said second conveying roller pair is capable of being forward and reversely driven, said control portion switches said second conveying roller pair from forward driving to reverse driving to convey a recording material to said discharging portion if the recording material is reversed and conveyed to said discharging portion, and if a preceding recording material is reversed and conveyed to said discharging portion and a following recording material is reversed and conveyed to said double surface conveyance passage, said second conveying roller pair reversed for conveying said preceding recording material to said discharging portion is separated by said separation means before said following recording material conveyed by said first conveying roller pair reaches said second conveying roller pair, and the rear end of said preceding recording material and the front end of said following recording material pass by each other at a location where said second conveying roller pair is provided while said second conveying roller pair is separated.

3. The image forming apparatus according to claim 2, wherein the second conveying roller pair is separated and said second conveying roller pair is switched to forward driving before said following recording material conveyed by said first conveying roller pair reaches said second conveying roller pair, the driving of said second conveying roller pair is stopped in timing in which said first conveying roller pair is switched from forward driving to reverse driving for conveying said following recording material toward said double surface conveying means, and in the timing, the control portion performs control so that the separation of said second conveying roller pair is continued.

4. The image forming apparatus according to claim 1, further comprising:

recording material size detecting means for detecting the size of a conveyed recording material; and determination means for determining whether or not said recording material reaches said second conveying roller pair based on the result of detection by the recording material size detecting means if said first conveying roller pair conveys the recording material to said double surface conveying portion;

wherein if it is determined by the determination means that the recording material does not reach said second conveying roller pair, control of the driving and separation of said second conveying roller is not performed when the recording material is reversed by said first conveying roller pair.

5. The image forming apparatus according to claim 1, wherein when the recording material is reversed and conveyed to said double surface conveying portion by said first conveying roller pair, said control portion performs control so that the separation of said second conveying roller pair is cancelled after a predetermined time determined according to the size of the conveyed recording material after said first conveying roller pair starts reverse driving.

6. A sheet conveying apparatus comprising:

a first conveying roller pair capable of forward and reversely rotating for reversing a sheet;

a second conveying roller pair conveying a sheet;

separation means for mutually separating the second conveying roller pair; and a control portion controlling the driving of said first and second conveying roller pairs and the operation of said separation means, wherein said control means performs control so that said second conveying roller pair is forward driven to convey the sheet conveyed by said forward rotating first conveying roller, and the driving of said second conveying roller pair is stopped and said second conveying roller pair is separated in timing in which said first conveying roller pair is switched from forward driving to reverse driving.

7. The sheet conveying apparatus according to claim 6, wherein said control portion controls so that the separation of said second conveying roller pair is cancelled after a predetermined time determined according to the size of the conveyed sheet after said first conveying roller pair starts reverse driving.

* * * * *

UNITED STATES PATENT AND TRADEMARK OFFICE

CERTIFICATE OF CORRECTION

PATENT NO. : 7,389,085 B2
APPLICATION NO. : 11/254820
DATED : June 17, 2008
INVENTOR(S) : Kitamura It is certified that error appears in the above-identified patent and that said Letters Patent is hereby corrected as shown below:

COLUMN 3:
Line 11, "process A" should read --process. A--.

COLUMN 4:
Line 10, "to FD" should read --to as FD--.

COLUMN 6:
Line 20, "alight" should read --a light--.

COLUMN 8:
Line 65, "rearend" should read --rear end--.

Signed and Sealed this

Twenty-fifth Day of November, 2008

JON W. DUDAS
*Director of the United States Patent and Trademark Office*